United States Patent [19]

Mann

[11] 4,127,200

[45] Nov. 28, 1978

[54] WHEEL CHAIR LIFT DEVICE

[76] Inventor: Elbert T. Mann, 37 S. 105 E. Pl., Tulsa, Okla. 74128

[21] Appl. No.: 834,388

[22] Filed: Sep. 19, 1977

[51] Int. Cl.[2] ..... B66C 1/00

[52] U.S. Cl. ..... 214/75 H; 212/59 R; 214/450

[58] Field of Search ..... 214/75 H, 450; 212/8, 212/50–53, 66–70, 59 R

[56] References Cited

U.S. PATENT DOCUMENTS

| | | | |
|---|---|---|---|
| 940,148 | 11/1909 | Hammond | 212/8 R |
| 2,289,487 | 7/1942 | Dickson | 212/51 |
| 3,519,154 | 7/1970 | Riley | 214/450 |
| 3,804,263 | 4/1974 | Castonguay | 214/450 X |
| 3,854,594 | 12/1974 | Brookes | 214/75 H X |

*Primary Examiner*—Albert J. Makay

*Assistant Examiner*—Donald W. Underwood

*Attorney, Agent, or Firm*—William S. Dorman

[57] ABSTRACT

An apparatus for hoisting a wheel chair into and out of an enclosure including a swivel base having a stationary section that may be secured within the closure and a section rotatable on the stationary section about a vertical axis. A motor mount is positioned above and is connected to the rotatable section of the swivel base. An angled arm is pivotally connected to the motor mount and is capable of standing rigidly upright when in use and capable of folding down when not in use. A cable, attached to a reel at one end, has a series of pulleys located on the angled arm to guide the cable over the angled arm. The reel is formed to the motor mount and is connected to a motor on the motor mount through use of gearing. A hook is formed at the other end of the cable for use in hoisting.

3 Claims, 6 Drawing Figures

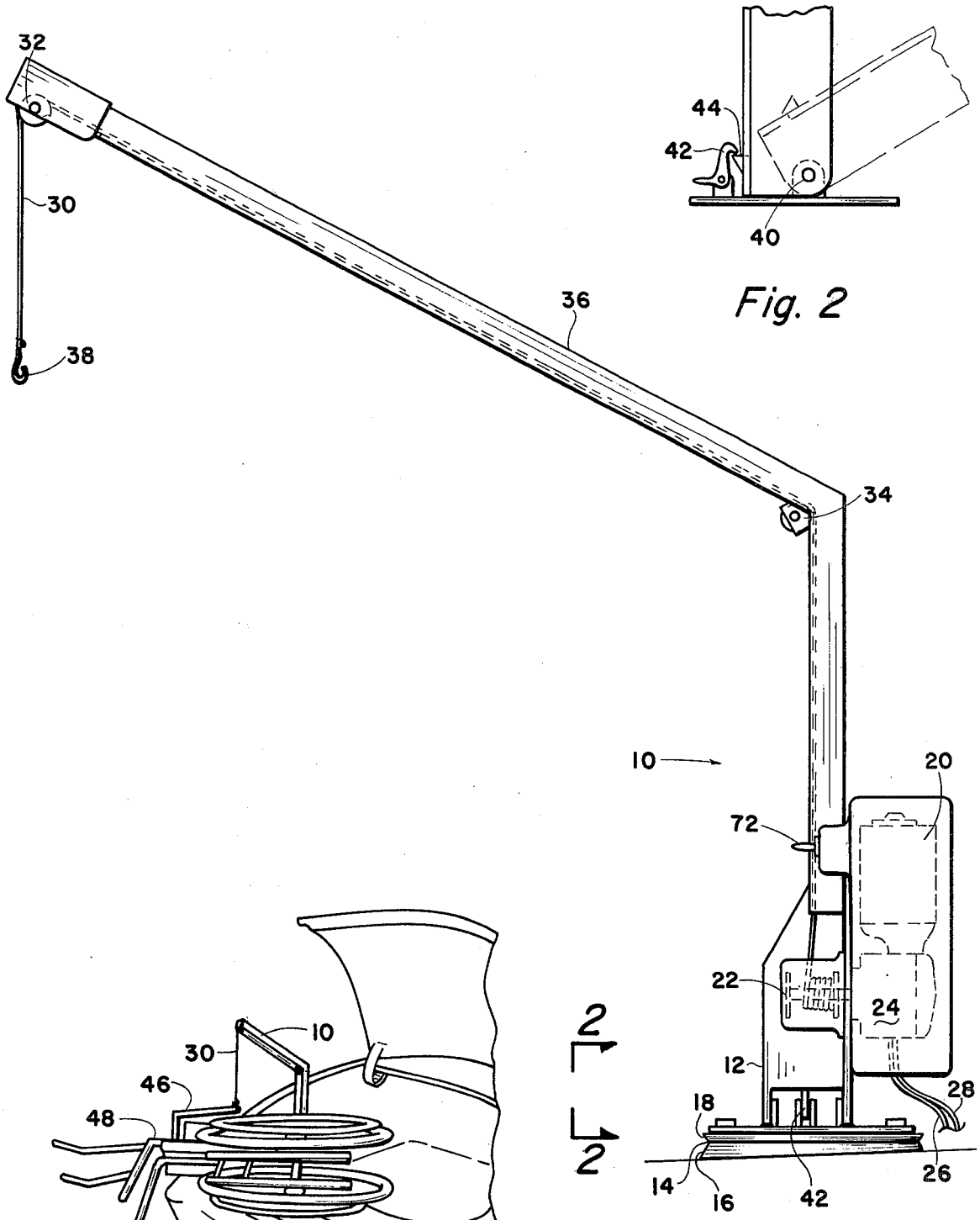
Fig. 1
Fig. 2
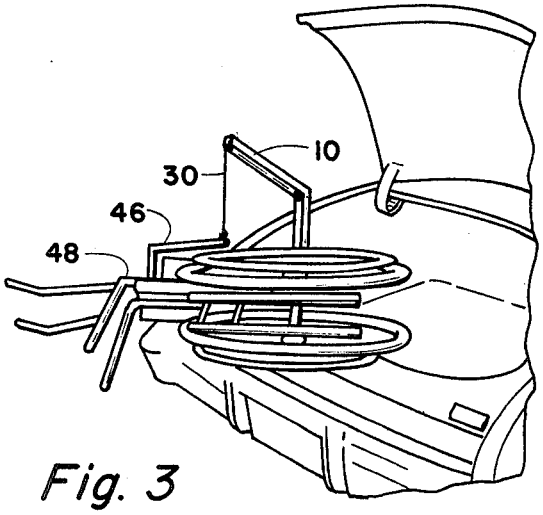
Fig. 3

WHEEL CHAIR LIFT DEVICE

BACKGROUND OF THE INVENTION

1. Field of the invention

This invention relates to a wheel chair lift device to be used in conjunction with an enclosure, such as the interior of an automobile. More particularly, this invention relates to a wheel chair lift device that may be easily operated by an invalid or by an assistant that may be quickly and simply attached within an enclosure such as a trunk of a car or the rear portion of a station wagon and is capable of folding down within the trunk of the car or the rear portion of the station wagon when not in use.

2. Description of the Prior Art

Concerning automobile travel for the invalid or semi-invalid, it is usually desirable to carry a wheel chair along on a trip or an outing. The wheel chair is usually placed in the trunk of a car or in the rear portion of a station wagon. For the semi-invalid, such as one who may be able to use crutches to get around, lifting a wheel chair may be impossible due to the weight of the chair. Even for an assistant, lifting a wheel chair into an automobile may prove to be a difficult task.

Ideally, a lift device should be constructed so as to be easily operable. It is also desirable to have the device mount on the interior of the automobile, such as in the trunk of a car or the rear portion of a station wagon.

SUMMARY OF THE INVENTION

The present invention designed for moving a wheel chair into and out of an enclosure, such as the trunk of an automobile or the rear portion of a station wagon, allows mounting within the interior of the automobile.

The device includes a motor housing or mount positioned above a swivel base rotatable on a vertical axis. The motor mount includes a motor which drives a pulley reel through a gear arrangement. A cable, attached at one end to the pulley reel, is allowed to move over intermediate pulleys located on an angled arm which extends upward from the motor mount. A hook formed at the other end of the cable permits attachment to the wheel chair and the lifting and lowering of the chair.

The angled arm and the motor mount are pivotally mounted at their lower end. A spring loaded latch holds the angled arm in an upright position when in use by engaging with a lip provided on the motor mount. Release of the latch permits the arm to be lowered into a substantially horizontal position.

Prior to loading the chair, a lifting bracket is slid over the folded wheel chair. The bracket, generally in the shape of a "U," is constructed to fit over a standard size wheel chair that has been folded. A horse shoe clamp is formed near an end of one of the legs of the bracket. A lifting eye is formed on the outer edge of the end of the other leg of the bracket A brace piece extends between the legs. A slide bar extends perpendicularly away from the brace piece and is slidably connected. A lock down bar extends away from and is perpendicular to the slide bar and is slidably connected.

To raise the wheel chair into a trunk, the lifting bracket is slid over the folded wheel chair and then the lock down bar is made to hold the chair in that position. After opening the trunk, the latch is made to hold the angled arm of the device in the upright position. By operating a switch on the motor mount, the cable is lowered to permit attachment to the lifting eye on the bracket. The chair and the surrounding bracket can then be raised by operating the switch. Next the angled arm is manually swung on the vertical axis so that the chair is over the open trunk. The chair is then lowered into the trunk by operating the switch. Finally, the latch is disengaged and the arm and mount are folded down.

In view of the above, it is a principal purpose and object of this invention to provide a wheel chair lift device that may be easily operated by an invalid or an assistant. It is also an object of this invention to provide a wheel chair lift device that may be mounted on the interior of an automobile and is capable of folding to fit within the automobile when not in use.

BRIEF DESCRIPTION OF THE DRAWINGS

FIG. 1 is a diagrammatic view of a wheel chair lift device constructed in accordance with one embodiment of the present invention showing the path of the cable along the angled arm indicated by dashed lines;

FIG. 2 is a diagrammatic view of the bottom of the motor mount of the wheel chair lift device shown in FIG. 1 indicating both the folded down position and the upright position;

FIG. 3 is a perspective view of the lift device shown in FIG. 1 mounted in the trunk of a car;

DETAILED DESCRIPTION OF THE PREFERRED EMBODIMENTS

Figure 5:
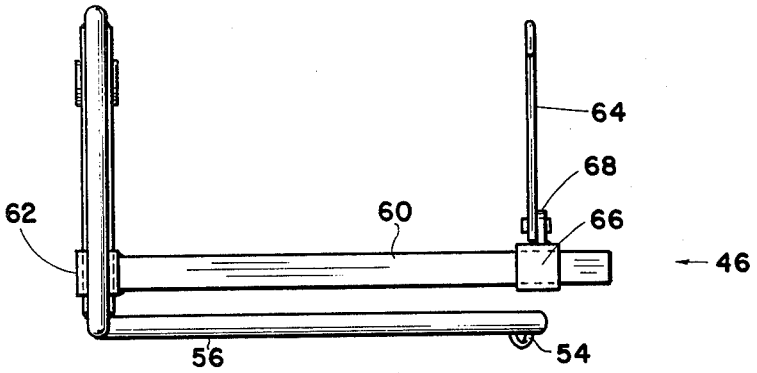
FIG. 5 is a top view of the lifting bracket shown in FIG. 4.

Referring to the drawings in detail, FIG. 1 shows a wheel chair lift device 10 designed for assisting in placing a wheel chair in, or removing a wheel chair from, the trunk of an automobile or the rear portion of a station wagon. The device includes a motor housing or mount 12 positioned above a swivel base 14 so that the entire assembly can be rotated about a vertical axis (not shown). The base 14 has a stationary section 16 that can be fastened within the trunk of a car or the rear portion of a station wagon and a rotatable section 18. The swivel base may have a stationary section that is sloped so as to adapt to the inside of the trunk.

Included on the motor mount 12 is a motor 20 which drives a pulley reel 22 through a gear arrangement 24. Wires 26 and 28 extend from the motor. One wire is attached to the positive side of the car battery and the other wire is grounded to the car frame.

A cable 30 is attached at one end to the pulley reel and the cable is allowed to move over intermediate pulleys 32 and 34 mounted on angled arm 36. A hook 38 formed at the other end of the cable 30 permits attachment to, and the lifting and lowering of, a wheel chair.

As best seen in FIG. 2, the angled arm 36 is pivotally mounted, for example, on a bolt 40 to the motor mount 12. A spring loaded latch 42 holds the angled arm in an upright position when in use by engaging with a lip 44 provided near the bottom of the motor mount. Release of the latch 42 permits the angled arm to be lowered into a substantially horizontal position after the wheel chair has been withdrawn from the trunk or after the wheel chair has been loaded back into the trunk so that the lid of the trunk can be closed. The positioning of the device 10, when in use in a car trunk, is best seen in FIG. 3.

Figure 4:
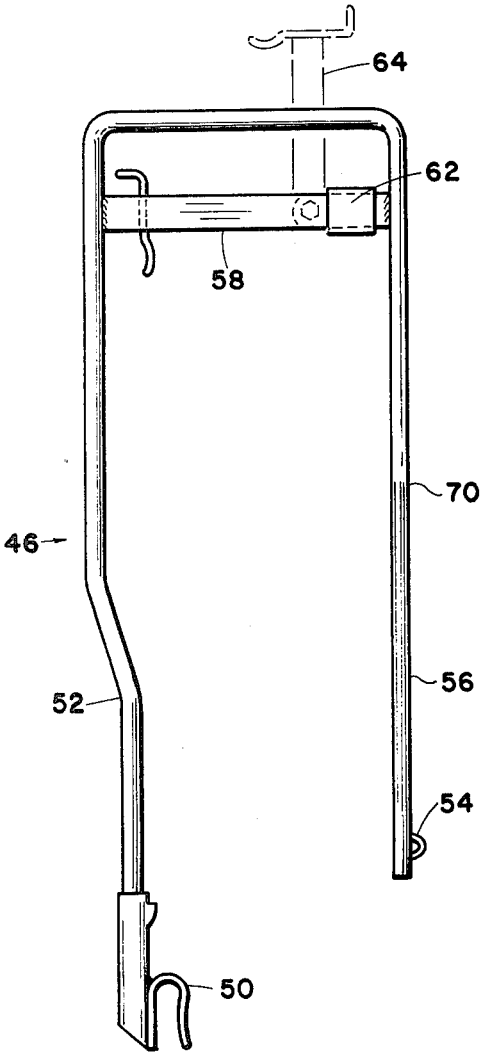
FIG. 4 is a front view of a lifting bracket that may be used in conjunction with the lift device in FIG. 1.
Figure 6:
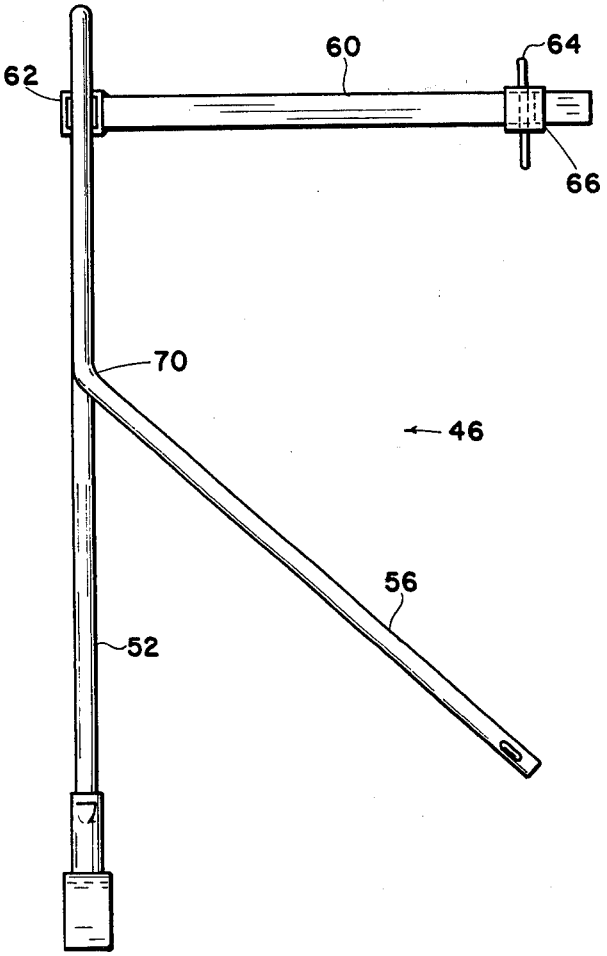
FIG. 6 is a side view of the lifting bracket shown in FIG. 4.

A lifting bracket 46 shown in FIGS. 4, 5 and 6, is slid over the wheel chair 48 prior to loading the device 10 into the trunk of a car or the back of a station wagon. The bracket 46 is generally in the shape of a "U," as best seen in FIG 4, and is constructed to fit over a folded wheel chair. The width of the bracket 46 is such that it is made to fit over a standard size wheel chair that has been folded. A horse shoe clamp 50 is formed near an end of one of the legs 52 of the bracket 46. The clamp 50 locks over the lower frame of the wheel chair 48 (not shown in FIGS. 4, 5 or 6). A lifting eye 54 is formed on the outer edge of the end of the other leg 56 of the bracket. A brace piece 58 extends between and perpendicular to the legs 52 and 56.

Extending away from and perpendicular to the brace piece 58 is a slide bar 60 which is slidably connected at 62 to the brace piece 58. A lock down bar 64 is slidably connected at 66 to the slide bar 60 and extends away from the slide bar and is parallel to the brace piece 58.

The lock down bar may also be allowed to pivot at 68, as best seen in FIG. 4. The leg 56 is angled back at 70 in the direction of the slide bar 60, as can be seen in FIG. 6.

To raise the wheel chair into the trunk of a car, the lifting bracket 46 is slid over the wheel chair after it has been folded. The lock down bar 64 is made to hold the wheel chair in the folded position. After opening the trunk, the latch 42 is made to hold the angled arm 36 in the upright position. The cable 30 is then lowered by operating a switch 72 on motor mount 12 in order to attach the hook 38 to the lifting eye 54 on bracket 46. By operating the switch 72 on the motor mount 12, the wheel chair 48 and the surrounding bracket can be raised. After the chair is at the proper level, the angled arm 36 is manually swung on the vertical axis so that the chair 48 and the surrounding bracket 46 are over the open trunk of the car. The chair 48 is then lowered into the trunk by operating the switch 72. Finally, the angled arm 36 is allowed to fold down into the trunk by releasing the spring loaded latch 42 thereby allowing the trunk to be closed To raise a folded wheel chair 48 into the rear portion of a station wagon, a similar operation would be performed.

To remove a wheel chair from the trunk of a car or from the back of a station wagon, the reverse operation would be performed.

Whereas the present invention has been described in particular relation to the drawings attached hereto, it should be understood that other and further modifications of the invention, apart from those shown or suggested herein, may be made within the spirit and scope of this invention.

What is claimed is:

1. Apparatus for hoisting a wheel chair into and out of an enclosure comprising a swivel base having a stationary section and a section rotatable on said stationary section about a vertical axis; means to secure said stationary section within said enclosure; a motor mount positioned above said rotatable section of said swivel base; means to connect said motor mount to said rotatable section; an angled arm pivotally connected at one end to said motor mount and the other end capable of standing rigidly upright when in use and capable of folding down when not in use; a cable having two ends; a plurality of pulley means located on said angled arm to conduct said cable along said angled arm; reel means formed at one end of said cable on said motor mount; hook means formed at the other end of said cable; motor means positioned on said motor mount; means to connect said reel means with said motor means for allowing said motor means to hoist said wheel chair; and a lifting bracket to fit over a folded wheel chair which comprises two legs generally parallel to each other, a connecting piece extending between one end of each of said legs, a brace piece extending between said legs parallel to said connecting piece, a slide bar slidably mounted on said brace piece and extending divergently perpendicular therefrom, a lock down bar slidably mounted on said slide bar and extending divergently perpendicular therefrom, a clamp means formed near the other end of one of the legs, and an eye formed near the end of the other leg for engaging with said hook means.

2. Apparatus for hoisting a wheel chair, as set forth in claim 1, wherein said pivotally connected angled arm is held upright through use of a spring loaded latch which is made to engage with a lip provided on said motor mount.

3. Apparatus for hoisting a wheel chair as set forth in claim 1, wherein the bottom of said stationary section of said swivel base is sloped to accomodate the contours of a trunk of a car.

* * * * *